US009203183B2

(12) United States Patent
Konchan et al.

(10) Patent No.: US 9,203,183 B2
(45) Date of Patent: Dec. 1, 2015

(54) ELECTRICAL CONNECTOR ASSEMBLY

(71) Applicant: GM Global Technology Operations LLC, Detroit, MI (US)

(72) Inventors: Jeffrey L. Konchan, Romeo, MI (US); Scott P. Charnesky, Birmingham, MI (US); Fred W. Huntzicker, Ann Arbor, MI (US); Herbert J. McBride, Ellisville, MO (US); Ricky T. Kim, Troy, MO (US); Nicholas J. Sachs, Wentzville, MO (US)

(73) Assignee: GM Global Technology Operations LLC, Detroit, MI (US)

( * ) Notice: Subject to any disclaimer, the term of this patent is extended or adjusted under 35 U.S.C. 154(b) by 128 days.

(21) Appl. No.: 13/954,440

(22) Filed: Jul. 30, 2013

(65) Prior Publication Data

US 2015/0037999 A1 Feb. 5, 2015

(51) Int. Cl.

| | |
|---|---|
| ***H01R 13/627*** | (2006.01) |
| ***H01R 43/26*** | (2006.01) |
| ***H01R 13/703*** | (2006.01) |

(52) U.S. Cl.

CPC ..... *H01R 13/6278* (2013.01); *H01R 13/6272* (2013.01); *H01R 13/703* (2013.01); *H01R 43/26* (2013.01)

(58) Field of Classification Search

CPC ..... H01R 13/6272; H01R 13/6273; H01R 13/6275; H01R 13/639; H01R 13/627

USPC ..... 439/358

See application file for complete search history.

(56) References Cited

U.S. PATENT DOCUMENTS

| | | | | |
|---|---|---|---|---|
| 4,530,559 | A * | 7/1985 | Burns et al. | 439/319 |
| 5,217,384 | A * | 6/1993 | Merten et al. | 439/304 |
| 6,390,843 | B1 * | 5/2002 | Lim | 439/346 |
| 6,554,626 | B2 * | 4/2003 | Ramos, Jr. | 439/144 |
| 7,097,514 | B2 * | 8/2006 | Ishizaki et al. | 439/681 |
| 7,186,130 | B1 * | 3/2007 | Miller | 439/369 |
| 7,306,472 | B2 * | 12/2007 | Matsumoto et al. | 439/314 |
| 7,452,233 | B1 * | 11/2008 | Michelsen | 439/369 |
| 7,497,721 | B2 * | 3/2009 | Lauermann et al. | 439/441 |
| 7,744,400 | B2 * | 6/2010 | Carmitchel | 439/369 |
| 7,758,370 | B1 * | 7/2010 | Flaherty | 439/352 |
| 7,758,371 | B2 * | 7/2010 | Carmitchel | 439/363 |
| 7,811,115 | B1 * | 10/2010 | Tyler | 439/352 |
| 8,052,458 | B2 * | 11/2011 | Rossman et al. | 439/358 |
| 8,206,170 | B2 * | 6/2012 | Matsumoto et al. | 439/347 |
| 8,328,574 | B1 * | 12/2012 | Lin | 439/321 |
| 8,357,005 | B2 * | 1/2013 | Hu | 439/353 |
| 8,376,767 | B2 * | 2/2013 | Kahara et al. | 439/304 |
| 8,480,424 | B2 * | 7/2013 | Koellmann | 439/358 |
| 8,632,353 | B2 * | 1/2014 | Rassoolkhani et al. | 439/358 |
| 8,690,596 | B2 * | 4/2014 | Su et al. | 439/354 |
| 8,784,126 | B2 * | 7/2014 | Chang | 439/358 |
| 8,787,025 | B2 * | 7/2014 | Wu | 361/740 |

* cited by examiner

*Primary Examiner* — Abdullah Riyami
*Assistant Examiner* — Vladimir Imas
(74) *Attorney, Agent, or Firm* — Cantor Colburn LLP

(57) ABSTRACT

An electrical connector assembly including a first connector having a first electrical conductor. A second connector is engagable with the first connector and has a second electrical conductor. The first and second electrical conductors establish an electrical connection through the electrical connector assembly when in contact together. A lock mechanism is arranged to both lock the first and second connectors together and to enable contact between the first and second conductors when the first and second connectors are in a fully engaged relation. A method of establishing an electrical connection through an electrical connector assembly is also included.

15 Claims, 4 Drawing Sheets

ELECTRICAL CONNECTOR ASSEMBLY

FIELD OF THE INVENTION

The subject invention relates to an electrical connector and, in particular, an electrical connector having a positive mechanical connection.

BACKGROUND

Electrical connector assemblies are used in a variety of industries including the automotive industry. Each assembly may include two or more connectors, e.g., a male portion and a female portion, a plug and a receptacle, etc., that form an electrical connection when physically engaged together. These assemblies can be equipped with a locking or latching mechanism to limit relative movement of the connectors after physical engagement thereof in order to prevent undesired disruption of the electrical connection. The reliability and verifiability of the lock mechanism are thus important in establishing a long lasting electrical connection that will not readily become disengaged over time or during use of the connector assembly.

Accordingly, it is desirable to provide an electrical connector assembly that reliably and/or verifiably forms a mechanical connection between two electrical connectors.

SUMMARY OF THE INVENTION

In one exemplary embodiment of the invention, an electrical connector assembly is provided. The electrical connector assembly includes a first connector having a first electrical conductor and a second connector engagable with the first connector that has a second electrical conductor. The first and second electrical conductors establish an electrical connection through the electrical connector assembly when in contact together. A lock mechanism is arranged to both mechanically lock the first and second connectors together and to enable contact between the first and second conductors when the first and second connectors are in a fully engaged relation.

In another exemplary embodiment of the invention, a method of establishing an electrical connection through an electrical connector assembly is provided. The method includes moving a first connector and a second connector of the electrical connector assembly together to engage the first and second connectors. Contact is prevented between a first conductor of the first connector and a second conductor of the second connector during the moving. The first and second connectors are mechanically locked together with a lock mechanism when the first and second connectors are moved to a fully engaged relation. Contact is enabled between the first and second connectors with the lock mechanism due to the locking. Electrical communication is performed through the electrical connector assembly.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
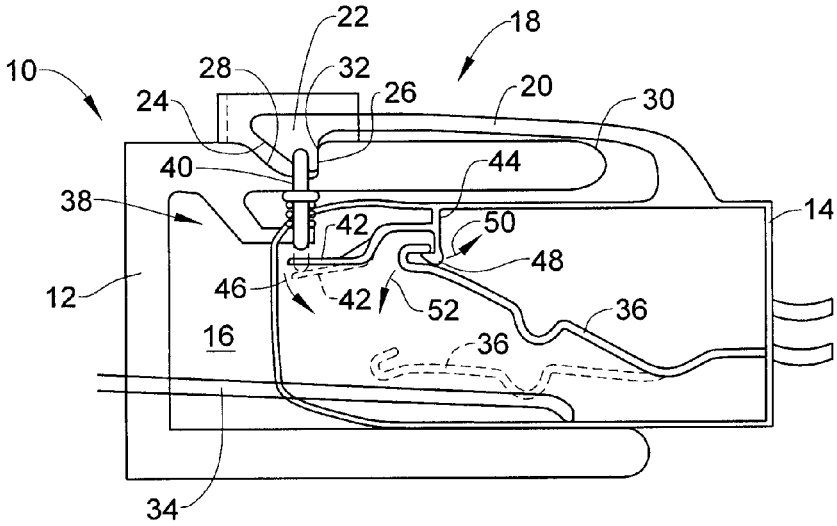
FIG. 1 is a cross-sectional view of an electrical connector assembly according to one embodiment disclosed herein.

The following description is merely exemplary in nature and is not intended to limit the present disclosure, its application or uses. It should be understood that throughout the drawings, corresponding reference numerals indicate like or corresponding parts and features.

In accordance with an exemplary embodiment of the invention, and with reference to FIG. 1, an electrical connector assembly 10 is provided. The electrical connector assembly 10 includes a first connector 12 and a second connector 14. The first connector 12 has an internal cavity 16 arranged to receive the second connector 14 therein. To this end, the first connector 12 may be alternatively or colloquially referred to as a socket, receptacle, or female connector, while the second connector 14 may be alternatively or colloquially referred to as a plug or male connector.

A lock mechanism 18 is included between the connectors 12 and 14 to mechanically and/or physically latch, lock, fasten, secure, or otherwise prevent relative movement between the connectors 12 and 14 when the connectors 12 and 14 are fully engaged together, that is, moved together into a fully engaged relation. In the illustrated embodiment, the mechanism 18 includes a resilient arm 20 extending from the connector 14 that terminates in a projection, protrusion, or head 22. The projection 22 includes a ramped or angled surface 24 and a locking surface 26. The connector 12 includes a notch, groove, step, shoulder, or recess 28 (generally, "notch") for receiving the projection 22 when the connectors 12 and 14 are fully engaged. To this end, the arm 20 can be, and/or represents, any suitable hinged, springing, resilient, and/or cantilevered beam, rod, bar, strip, filament, etc. that enables the projection 22 to progressively "climb" a ramped or angled surface 30 of the connector 12 and then drop or snap the projection 22 into the notch 28 when aligned therewith. The resiliency of the arm 20 can also be provided by a separate biasing element, e.g., a spring or resilient material disposed with the arm 20.

The notch 28 has a shoulder 32 that is oriented substantially parallel to the locking surface 26. In this way, relative movement between the connectors 12 and 14 is limited by mating engagement of the surface 26 with the shoulder 32 when the projection 22 is located within the notch 28. It is noted that a user can manually manipulate lock mechanism 18 to release the connectors 12 and 14, e.g., by first lifting the projection 22 out of the notch 28 and then disengaging the connectors 12 and 14 by moving the connectors 12 and 14 apart.

The connector 12 has a first conductor 34 and the connector 14 has a second conductor 36, such that contact between the first and second conductors 34 and 36 establishes an electrical connection between the connectors 12 and 14. The conductors 34 and/or 36 can be arranged as blades, wires, etc., or other structures made from or including electrically conductive materials, e.g., metal. Advantageously, the conductors 34 and 36 are prevented from contacting until the connectors 12 and 14 are fully engaged and locked by the lock mechanism 18. In other words, the lock mechanism 18 is arranged to both enable contact to be made between the conductors 34 and 36, and to physically lock the connectors 12 and 14 together when the connectors 12 and 14 are moved into a fully engaged relation. In this way, electrical inspection of the connection formed through the assembly 10 also verifies that the connectors 12 and 14 are fully engaged and locked together.

Specifically with respect to the illustrated embodiment, the lock mechanism 18 enables electrical connection through the connector assembly 10 by actuating a contactor device 38. In the illustrated embodiment, actuation of the contactor device 38 is accomplished by the projection 22 depressing a plunger 40 or other actuator when the projection 22 is snapped or driven into the notch 28, e.g., due to the resiliency and/or spring-like nature of the arm 20. The plunger 40 in turn presses a lever 42, thereby causing the lever 42 to rotate about a hinge or pivot section 44. The rotation of the lever 42 is generally identified by an arrow 46. Actuation of the lever 42, e.g., rotation of the lever 42 about the hinge section 44, results in a corresponding actuation of a finger 48 of the contactor device 38. For example, rotation of the finger 48 due to actuation of the lever 42 in the illustrated embodiment is represented by an arrow 50. The rotation or other actuation of the finger 48 causes the contactor device 38, namely the finger 48 of the contactor device 38, to release the conductor 36. The conductor 36 can be resilient, spring-like, or otherwise arranged to move into contact with the conductor 34 when released by the contactor device 38, as indicated by an arrow 52. The resilient movement can also be provided by a separate biasing element, e.g., a spring or resilient material disposed with the conductor 34. Dashed lines are included to represent the conductor 36, the plunger 40, and the lever 42 when in the actuated configuration.

Figure 2:
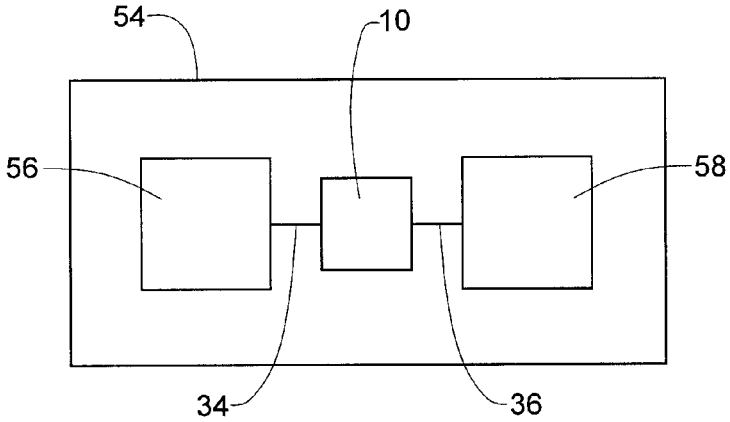
FIG. 2 is schematically illustrates an automobile including the electrical connector assembly of FIG. 1.

The assembly 10 (and other assemblies discussed herein below) is generally applicable to any industry in which electrical connections must be made between pairs of electrical components. The assembly 10 (and other embodiments disclosed herein) imparts particular benefits to electrical connector assemblies that are subject to constant vibration or long periods of loading, positioned in locations that are difficult to access, etc., such as the automotive industry. Accordingly, FIG. 2 schematically illustrates an automobile 54 including the assembly 10 in order to establish an electrical connection between a first component 56 and a second component 58. The first and second components 56 and 58 can be any two components requiring an electrical connection, i.e., electrical communication, therebetween. As shown, the first component 56 is electrically coupled to the assembly 10 via the conductor 34 and the second component 58 is electrically coupled to the assembly 10 via the conductor 36. The terms electrical connection, electrically coupled, and electrical communication are meant to be generally interchangeable and include the ability to communicate power, signals, and/or data electrically. For example, in one specific non-limiting embodiment, the first component 56 is a power lock mechanism for a door of the automobile 54 and the second component 58 is a power source, a switch, a button, and/or a trigger for powering and/or controlling actuation of the power lock mechanism. Any number of pairs of electrical components can be coupled together via the assembly 10. Advantageously, a standard test of the proper functionality of the electrical components of the automobile 54 will also verify that all of the assemblies 10 are mechanically locked, as contact between the conductors 34 and 36 is prevented until the lock mechanism 18 has locked the connectors 12 and 14 together, whereas an electrical inspection cannot be relied upon to indicate a locked status between connectors in previously known connector assemblies. Those of ordinary skill in the art will recognize a myriad of electrical components both within and outside of the automotive industry that can be connected by and benefit from the embodiments disclosed herein.

It is of course to be understood that the lock mechanisms and/or contactor devices of electrical connector assemblies can take forms other than that illustrated in FIG. 1, which also act to initially prevent and then selectively permit, enable, or establish contact between a pair of conductors in response to the lock mechanism assuming locked engagement between corresponding connectors of the assemblies. Several non-limiting examples are provided in FIGS. 3-10 and described below. It is thus to be appreciated that the embodiments of FIGS. 3-10 can be used generally in lieu of the assembly 10, e.g., within the automobile 54, or for electrically connecting any two electrical components.

Figure 3:
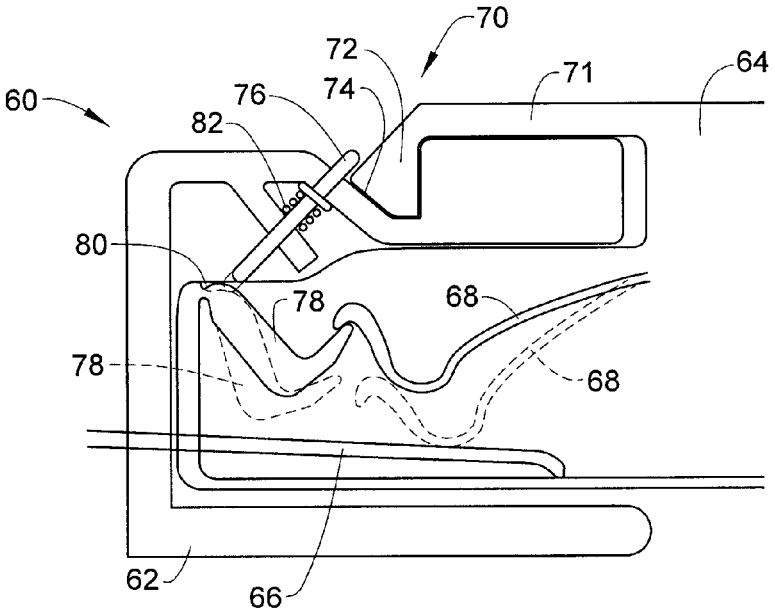
FIGS. 3-10 illustrate electrical connector assemblies according to various embodiments disclosed herein.

FIG. 3 illustrates an assembly 60 that is similar to the assembly 10 in many respects, e.g., including a first connector 62 that is arranged to receive a second connector 64 in order to establish an electrical connection between a first conductor 66 and a second conductor 68 respectively thereof. The assembly 60 includes a lock mechanism 70 that similarly includes a resilient arm 71 terminating in a projection 72, which is located within a notch 74 in order to lock the connectors 62 and 64 together when the connectors 62 and 64 are fully engaged. As the projection 72 is urged into the notch 74, a plunger 76 is depressed in order to actuate a lever 78 by rotating the lever 78 at a hinge 80. Rotation of the lever 78 about the hinge 80 causes the lever 78 to release the conductor 68, such that the conductor 68 can move into contact with the conductor 66. Dashed lines are provided to illustrate the lever 78 and the conductor 68 in the actuated/released configuration. Unlike the plunger 40 of the assembly 10, the plunger 80 is able to return to its initial position, e.g., under the influence of a spring 82 or other biasing element. When returned to its initial position, the plunger 80 assists in locking the connectors 62 and 64 together by presenting a further obstacle that prevents the projection 72 from exiting engagement within the notch 74.

Figure 4:
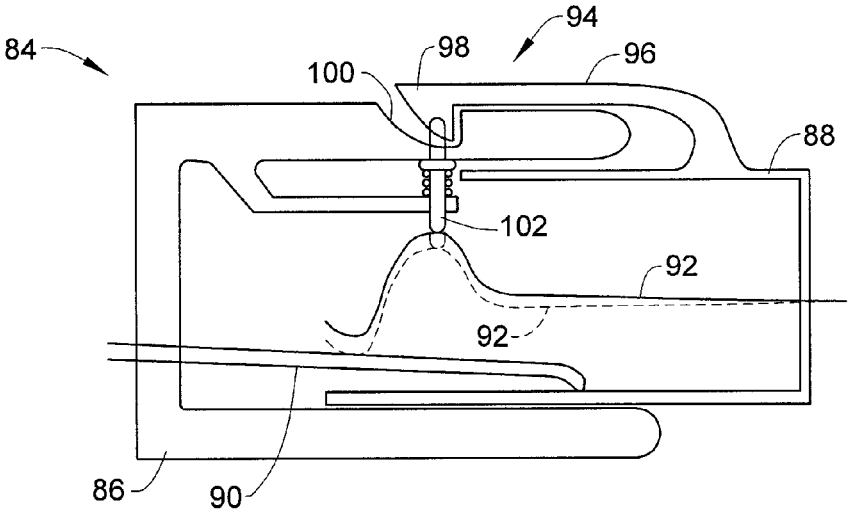

An assembly 84 is depicted in FIG. 4, including a first connector 86 and a second connector 88, having a first conductor 90 and a second conductor 92, respectively. A lock mechanism 94 is included having a resilient arm 96 and a projection 98 that is engagable in a notch 100 in order to lock the connectors 86 and 88 together. Engagement of the projection 98 in the notch 100 causes the projection 98 to actuate a plunger 102. When actuated, the plunger 102 presses the conductor 92 into contact with the conductor 90. Unlike the embodiments of FIGS. 1 and 3, the lock mechanism 94 does not cause release of the conductor 92, but instead actively holds the conductor 92 against the conductor 90 as long as the lock mechanism 94 is locking the connectors 86 and 88 together.

Figure 5:
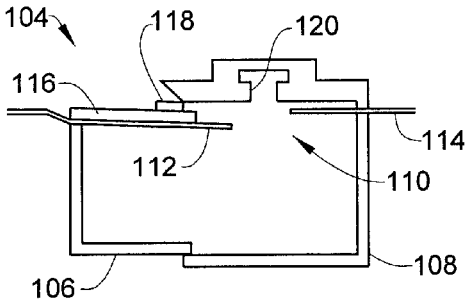
Figure 6:
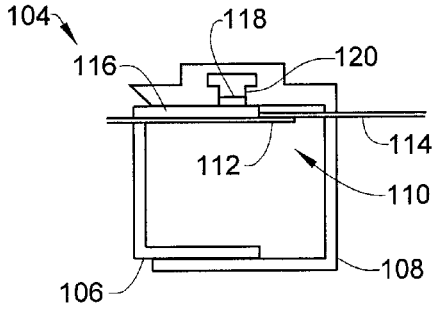

FIGS. 5 and 6 depict an assembly 104 having a first connector 106 and a second connector 108 arranged in a disengaged and a fully engaged, locked configuration, respectively. That is, when the first and second connectors 106 and 108 are fully engaged together, as shown in FIG. 6, a lock mechanism 110 brings a first conductor 112 of the first connector 106 and a second conductor 114 of the second connector 108 into contact in order to establish an electrical connection through the assembly 104. The lock mechanism 110 includes a resilient arm 116 terminating in a projection 118. The projection 118 is arranged to displace the conductor 112 away from possible contact with the conductor 114 until the projection 118 enters a notch 120. The conductor 112 can be affixed to the arm 116, resiliently disposed against the arm 116, etc., in order to provide contact with the conductor 114 when the projection 118 enters the notch 120.

Figure 7:
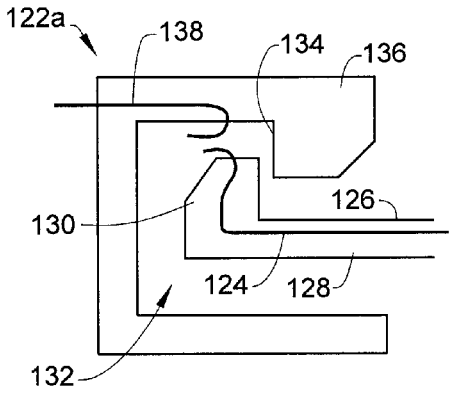
Figure 8:
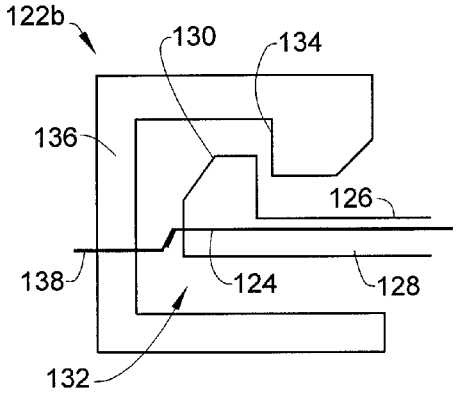

FIGS. 7 and 8 depict a pair of similar assemblies, designated 122*a* and 122*b* (collectively "the assemblies 122"), respectively, which are shown only in part. The assemblies 122 each include a first conductor 124 of a first connector 126 that is formed directly within and/or through a resilient arm 128 and a projection 130 of a lock mechanism 132. The projection 130, similar to the projections discussed in the embodiments above, is received within a notch 134 in order to lock the connector 126 to a second connector 136. When the projection 130 is located within the notch 134, the conductor 124 is brought into contact with a second conductor 138 in order to establish an electrical connection through the assemblies 122.

Figure 9:
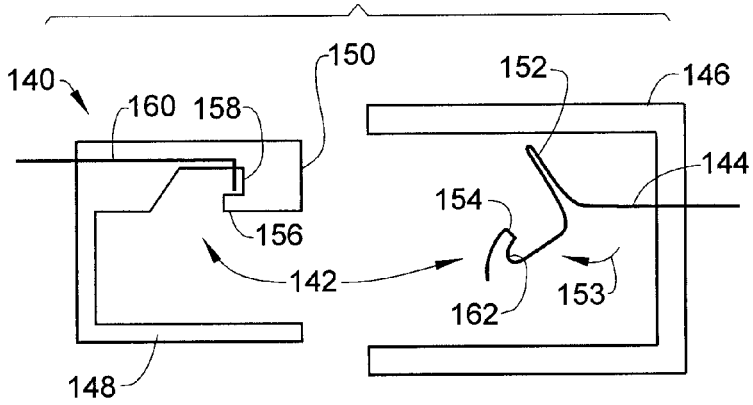

An assembly 140 is depicted in FIG. 9 in which a lock assembly 142 is formed in part by a first conductor 144 of a first connector 146. When the first connector 146 is moved into a fully engaged relation with a second connector 148, a shoulder 150 of the connector 148 will press against a lever 152 formed by, or connected to, the conductor 144. Pressing the shoulder 150 against the lever 152 will rotate the lever 152 as indicated by an arrow 153. This rotation also causes a contact portion 154 of the conductor 144 to rotate about a lip 156 of the connector 148, thereby positioning the contact portion 154 in a notch 158 in contact with a second conductor 160 of the second connector 148. The rotation, e.g., as indicated by the arrow 153, also positions the lip 156 within a notch 162 of the conductor 144. Once so positioned, the connectors 146 and 148 are effectively locked together by engagement of the contact portion 154 and the lip 156 with their respective notches 158 and 162 and the shoulder 150 being positioned or trapped between the lever 152 and the contact portion 154 of the conductor 144.

Figure 10:
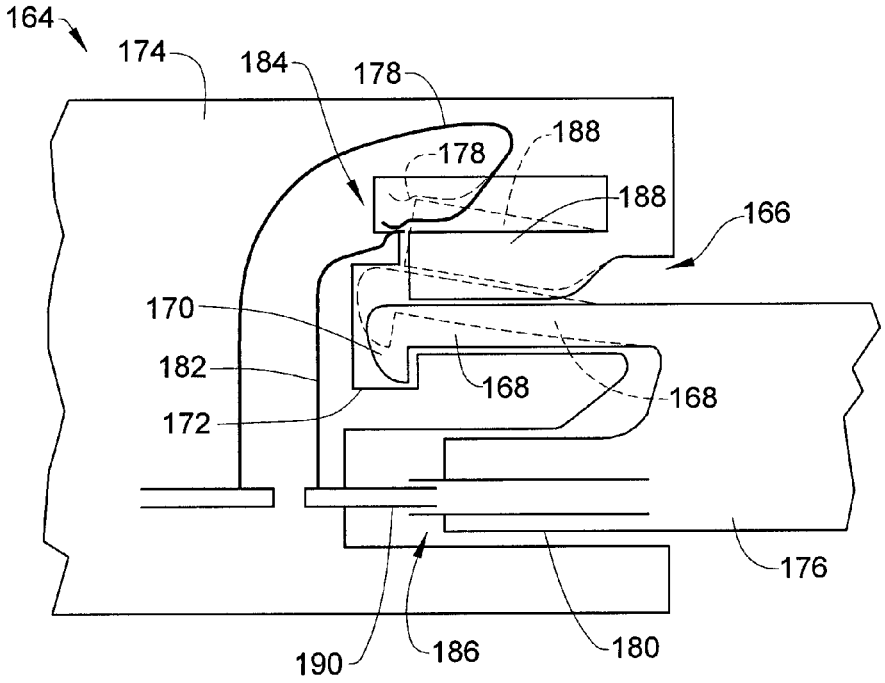

FIG. 10 illustrates an assembly 164 according to yet another embodiment disclosed herein. The assembly 164, similar to several embodiment discussed above, includes a lock mechanism 166 comprising a resilient arm 168 having a projection 170 thereon. The projection 170 is arranged to engage within a notch 172 in order to lock a first connector 174 and a second connector 176 together. The first connector 174 includes a first conductor 178 and the second connector 176 includes a second conductor 180. Unlike the other embodiments disclosed herein, a third or intermediate conductor 182 is provided. An electrical connection through the assembly 164 is not established until contact is made at both a first interface 184 between the first conductor 178 and the intermediate conductor 182 and at a second interface 186 between the second conductor 180 and the intermediate conductor 182. In other words, contact between the first conductor 178 and the second conductor 180 is established indirectly via contact of both of the conductors 178 and 180 with the intermediate conductor 182. In this way, the intermediate conductor 182 essentially acts as an extension of the first conductor 178 and/or the second conductors 180.

When the connectors 174 and 176 are moved together, but before the projection 170 is located within the notch 172, the projection 170 will cause the arm 168 to press against a lever 188. Actuation of the lever 188 displaces the first conductor 178 from the intermediate conductor 182 at the interface 184. Thus, even if contact is made at the interface 186, e.g., by the second conductor 180 engaging a stub 190 of the intermediate conductor 182, the actuation of the lever 188 by the lock mechanism 166 will disrupt contact at the first interface 184. Contact between the first and second conductors 178 and 180 is thus not possible until contact is separately made at both the interfaces 184 and 186, which only occurs after the projection 170 engages the notch 172, thereby releasing the lever 188 to return to its initial position and establish contact at the first interface 184.

It is again to be appreciated that the illustrated embodiments represent various non-limiting examples that include a lock mechanism that both locks together two connectors of an electrical connector assembly and enables contact between two conductors thereof in order to establish an electrical connection through the assembly. It is noted that features of the various illustrated embodiments can be combined together or interchanged, or otherwise utilized with non-illustrated features, whether piecemeal or in combination, to form yet further embodiments without departing from the intended scope of the invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An electrical connector assembly comprising:

a first housing;

a first connector coupled to the first housing and having a first electrical conductor, the first electrical conductor being resiliently movable from a first position to a second position;

a second housing;

a second connector coupled to the second housing and having a second electrical conductor, the first and second electrical conductors establishing an electrical connection through the electrical connector assembly when in contact together; and a lock mechanism that is arranged to mechanically lock the first housing and the second housing together and to release the first conductor from the first position to resiliently move into the second position in contact with the second conductor when the first housing and second housing are in a fully locked position, wherein the lock mechanism includes a resilient arm having a projection thereon and a notch arranged to receive the projection in order to lock the first and second connectors together;

wherein at least one of the first or second conductors is coupled to the resilient arm, the projection, or a combination including at least one of the foregoing.

2. The electrical connector assembly of claim 1, wherein the first and second connectors together comprise a male connector and a female connector.

3. The electrical connector assembly of claim 1, wherein the lock mechanism is arranged to press the first and second conductors together.

4. An electrical connector assembly comprising a first connector having a first electrical conductor;

a second connector engagable with the first connector and having a second electrical conductor, the first and second electrical conductors establishing an electrical connection through the electrical connector assembly when in contact together;

a lock mechanism that is arranged to both mechanically lock the first and second connectors together and to enable contact between the first and second conductors when the first and second connectors are in a fully engaged relation, wherein the lock mechanism includes a resilient arm having a projection thereon and a notch arranged to receive the projection in order to lock the first and second connectors together; and wherein the projection is arranged to actuate a plunger in communication with at least one of the first or second conductors when the projection is engaged within the notch.

5. The electrical connector assembly of claim 4, wherein the plunger presses the first and second conductors together.

6. The electrical connector assembly of claim 4, wherein the first conductor is initially supported by a lever, the lever arranged to release the first conductor when the lever is actuated by the plunger, the first conductor arranged to move resiliently when released by the lever to contact the second conductor.

7. The electrical connector assembly of claim 4, wherein the plunger creates a barrier preventing the projection from disengaging from the notch after the plunger is actuated by the projection.

8. The electrical connector assembly of claim 1, wherein the at least one of the first or second conductors is disposed within or through the resilient arm, the projection, or a combination including at least one of the foregoing.

9. The electrical connector assembly of claim 1, further comprising an intermediate conductor selectively engaging the first and second conductors in response to the first connector and the second connector being in a fully engaged relation.

10. The electrical connector assembly of claim 9, wherein the projection is arranged to press the resilient arm against a lever until the projection is located within the notch in order to actuate the lever, the lever displacing the first conductor and the intermediate conductor from each other.

11. The electrical connector assembly of claim 9, wherein the intermediate conductor is disposed with the first connector.

12. The electrical connector assembly of claim 1, wherein the lock mechanism is at least partially comprised by the first conductor.

13. The electrical connector assembly of claim 12, wherein the first conductor is arranged with a contact portion, a lever, and a notch, and the second connector is arranged with a shoulder that is engagable with the lever to rotate the contact portion of the first conductor about a lip into contact with the second conductor such that the lip is positioned within the notch and the shoulder is positioned between the lever and the contact portion of the first conductor.

14. An automobile including an electrical connector assembly according to claim 1.

15. The automobile of claim 14, further comprising a first electrical component and a second electrical component, the first and second electrical components in electrical communication with the first and second conductors, respectively.

* * * * *